United States Patent [19]

Bendt

[11] 4,202,449

[45] May 13, 1980

[54] PROTECTING DEVICE FOR EDGES

[76] Inventor: Anders Bendt, Nørdlige Bjergevej 5, DK - 8270 Hojbjerg, Denmark

[21] Appl. No.: 877,507

[22] Filed: Feb. 13, 1978

[30] Foreign Application Priority Data

Feb. 24, 1977 [DK] Denmark ..... 802/77

[51] Int. Cl.[2] ..... B65D 81/02; B65D 85/30

[52] U.S. Cl. ..... 206/453; 206/586; 206/597; 229/DIG. 1; 428/182; 428/400

[58] Field of Search ..... 229/DIG. 1; 206/597, 206/586, 453; 428/182, 400

[56] References Cited

U.S. PATENT DOCUMENTS

| | | | |
|---|---|---|---|
| D. 192,385 | 3/1962 | Anderson | 206/453 |
| 1,697,891 | 1/1929 | Weichsel | 206/597 |
| 1,814,968 | 7/1931 | Schario | 206/453 |
| 2,037,609 | 4/1936 | Vizcaino | 206/597 |
| 2,266,181 | 12/1941 | Epps | 206/453 |
| 3,047,142 | 7/1962 | Heffley | 206/597 |
| 3,049,260 | 8/1962 | Stone | 206/586 |
| 3,073,439 | 1/1963 | Symmonds | 206/453 |
| 3,152,693 | 10/1964 | Anderson | 206/453 |
| 3,199,709 | 8/1965 | Morrison et al. | 206/453 |
| 3,416,652 | 12/1968 | Almasy | 206/453 |
| 3,637,234 | 1/1972 | Thomas et al. | 206/453 |
| 4,082,187 | 4/1978 | Carlson | 206/586 |
| 4,120,441 | 10/1978 | Hurley | 206/453 |

FOREIGN PATENT DOCUMENTS

| | | | |
|---|---|---|---|
| 406844 | 12/1909 | France | 206/586 |
| 1493073 | 7/1967 | France | 206/586 |

*Primary Examiner*—J. C. Cannon

*Attorney, Agent, or Firm*—Stevens, Davis, Miller & Mosher

[57] ABSTRACT

Disclosed is a protecting device for use on the edges of boxes, cartons or like objects, especially, but not exclusively, on edge areas where ropes or lashings are tied around the objects. The protecting device is generally formed from a rod from which pieces of desired length can be cut off and has generally, but not exclusively, a right angular cross section, an outward protruding arcuate shape covering threequarters or substantially threequarters of a circle at the vertex of the angle, and sides of the angle which may be bent outward at their outer ends and/or provided with wave-shaped outward protrusions.

1 Claim, 3 Drawing Figures

PROTECTING DEVICE FOR EDGES

BACKGROUND OF THE INVENTION

1. Field of the Invention

The present invention relates to a protecting device for edges with angular, generally right angular cross section, and preferably for objects as boxes, cartons or the like of cardboard or corrugated paper or the like material with a limited mechanical strength and especially, but not exclusively, on edge areas where ropes or lashings are tied around the objects, which in view of transportation are piled on pallets. It would be understood that the edges of such objects during the transport may be exposed to deformation or damage especially on the edge areas where the lashing passes sharp edges, thus exerting a high local load. Also, it may be necessary during transport to protect the edges of such objects outside the lashing areas.

2. Description of the Prior Art

From the French Pat. Nos. 406 844 and 1 493 073 angular protecting devices are known, which are only adapted to placement under a rope, and by which the inner surface of the device forms an angle corresponding to that of the edge and further is provided with an inward directed groove for the rope to ensure that the device is kept in position. Apart from distributing the load over a greater area this, however, will cause a local deformation of the edge of the object.

SUMMARY OF THE INVENTION

It is therefore an object of this invention to provide a protecting device for the edges of boxes or the like objects, especially during transport, which is simple and cheap to manufacture and easy to use, and which may effectively protect the edges against any damage or deformation.

More especially the invention relates to a protecting device for edges having an angular, generally right angular cross section, whereby the vertex of the angle has an outward protruding arcuate shape covering threequarters or substantially threequarters of a circle. This ensures that any load occuring on the device will be transmitted to the sides of the object adjacent the edge but not the edge proper. Further due to the increased number of bends in the profile the device will have a greater stiffness in its longitudinal direction, which will improve the distribution of the load.

Owing to this special shape of the corner of the device, the rope or lashing will be positioned at some distance from the side of the angle, so that it may be possible that the, when under a heavy load applied by the lashing and due to flexibility of the device, may diverge placing their free ends at some distance from the surface of the object, which is undesireable because among other reasons the load on the object will be concentrated adjacent its edge. To avoid this according to a further embodiment of the invention, the sides of the angle at their outer end may be bent outward to abut against the lashing and/or the sides of the angle may be provided with one or more wave-shaped outward protrusions, the height of which equals or exceeds that of the circular shape of the corner.

Due to the fact that the protecting device according to this invention, contrary to the known art mentioned above, is provided with a constant cross section, it may preferably be produced as a rod of arbitrary length by extruding, of, for example, a suitable plastic material from which during use the protecting devices my be cut off in any desireable length. To facilitate the extrusion process the device is preferably provided with a constant wall thickness.

DESCRIPTION OF THE PREFERRED EMBODIMENTS

Figure 1:
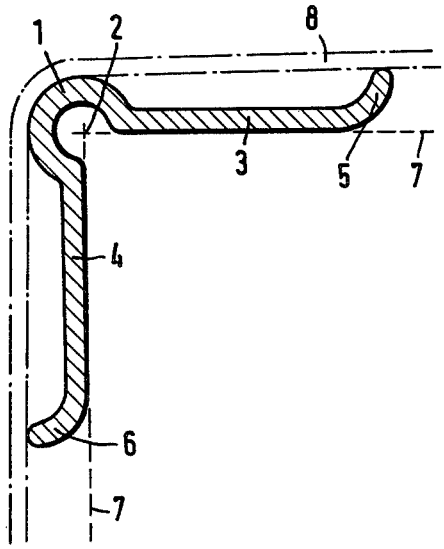
FIG. 1 is a sectional view of a protecting device according to the invention.

By the embodiments shown, the protecting device according to the invention is placed on a right-angled edge as indicated by dotted lines 7 of an object, for example, a corrugated paper box the edges of which shall be protected. The protecting device consists of a rod cut off in a suitable length and with an angular cross section, the vertex of which is a cylinder 1 covering about threequarters of a circle and continuing in angle sides 3 and 4, so that the axis 2 of the cylinder surface, when the device is positioned, will be substantially coincident with the edge of the object to be protected.

In use the protecting device according to this invention is normally kept in position by a rope or lashing 8 as indicated by dot-and-dash lines. However, if necessary, it may also be kept in position by other means, for example, adhesive tapes.

To ensure that the angle sides, 3, 4 over their whole length will abut against the surfaces, the free ends 5 and 6 respectively of the sides are turned outward as shown in FIG. 1 to abut against the lashing 8.

Figure 2:
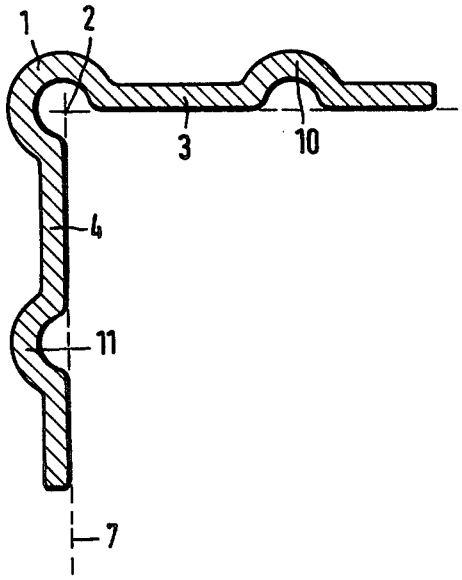
FIGS. 2 and 3 are sectional views of two further embodiments of the invention.

By providing the side of the angle 3 and 4 with outward directed wave-like protrusions 10 and 11 as shown in FIG. 2, having a height equal to or somewhat greater than the radius of the vertex circle, a more equal distribution of the load from the rope 8 over the abutment surface of the side 7 of the object will be achieved.

Figure 3:
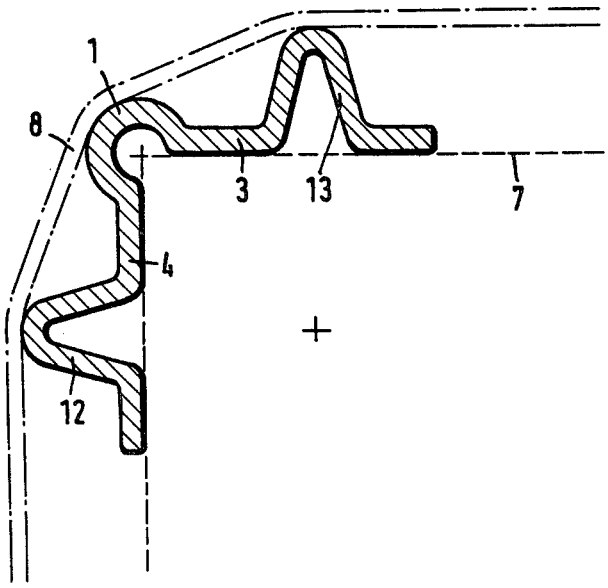

To ensure an equal distribution of the abutment force the wave-like protrusions 12 and 13 show in FIG. 3 may be of such a height that their outer surface as well as the outer surface of the cylinder 1 will touch an arc of the circle, the center of which lies in the bisector of the device angle. Taking the possibility of elastic deformation into account, the side of the angle may be provided with additional like protrusions.

Preferably, the protecting device is produced by the extrusion of a suitable plastic material, so that it may be delivered as rods of suitable length, from which during use, pieces of desired length may easily be cut off.

Further modifications and alternative embodiments of the invention will be apparent to those skilled in the art in view of the description. Accordingly, this description is to be construed as illustrative only and is for the purpose of teaching those skilled in the art the manner of carrying out the invention. It is to be understood that, if the angle of the edge of the object to be protected is not a right angle, the device may be provided with a corresponding angle. Further it is not necessary that the center of the arcuate shape of the corner of the device coincide exactly with the edge of the object, all as would be apparent to one skilled in the art after having the benefit of this description of the invention.

What I claim is:

1. A protecting device for edges with annular, generally right angular cross section, said device comprising an angular shaped elongated extruded plastic rod having a uniform cross section along its entire length and a substantially constant material thickness across its width, the vertex of the rod angle having an outward protruding acruate shape covering substantially three-quarters of a circle, and each of the sides of the rod angle having at a distance from the vertex circle at least one wave shaped outward protrusion with a height equal to or exceeding that of the arcuate shaped vertex of the rod angle, said vertex circle being connected with said wave shaped outward protrusion by substantially flat portions of said rod which are adapted to abut areas adjacent edges to be protected such that loads applied to said rod are transmitted to said flat areas and not to said edges.

* * * * *